United States Patent [19]

Tomiyama et al.

[11] Patent Number: 4,939,060

[45] Date of Patent: Jul. 3, 1990

[54] MAGNETIC TONER FOR DEVELOPING ELECTROSTATIC IMAGES

[75] Inventors: Koichi Tomiyama, Kawasaki; Seiichi Takagi, Yokohama; Ichiro Ohsaki, Kawasaki; Satoshi Yasuda, Matsudo; Yoshihiko Hyosu, Machida, all of Japan

[73] Assignee: Canon Kabushiki Kaisha, Tokyo, Japan

[21] Appl. No.: 420,732

[22] Filed: Oct. 12, 1989

Related U.S. Application Data

[63] Continuation of Ser. No. 313,457, Feb. 22, 1989, abandoned.

[30] Foreign Application Priority Data

Feb. 29, 1988 [JP] Japan ..... 63-44360
Feb. 29, 1988 [JP] Japan ..... 63-44363
Feb. 29, 1988 [JP] Japan ..... 63-46891

[51] Int. Cl.[5] ..... G03G 9/14

[52] U.S. Cl. ..... 430/106.6; 430/903; 430/109; 430/111; 526/934; 525/934; 524/904; 524/901

[58] Field of Search ..... 430/106.6, 903, 109, 430/111

[56] References Cited

U.S. PATENT DOCUMENTS 4,401,741 8/1983 Miyakawa ..... 430/903
4,702,986 10/1987 Imai et al. ..... 430/120
4,824,752 4/1989 Yasuda et al. ..... 430/106.6

*Primary Examiner*—J. David Welsh
*Attorney, Agent, or Firm*—Fitzpatrick, Cella, Harper & Scinto

[57] ABSTRACT

A magnetic toner for developing electrostatic images, comprising at least a binder resin and a magnetic powder; the binder resin having 10 to 70 wt. % of a THF (tetrahydrofuran)-insoluble and a THF-soluble, the THF-soluble providing a molecular weight distribution in the chromatogram of GPC (gel permeation chromatography) thereof such that it provides a rate (Mw/Mn) of weight-average molecular weight (Mw)/number-average molecular weight (Mn)≧5, there are a peak in the molecular weight range of 2,000 to 10,000 and a peak or shoulder in the molecular weight range of 15,000 to 100,000 and a component having a molecular weight of 10,000 or smaller is contained in an amount of 10–50 wt. % based on the binder resin; the magnetic powder comprising spherical magnetic particles having a bulk density of 0.6 g/ml or larger.

24 Claims, 6 Drawing Sheets

MAGNETIC TONER FOR DEVELOPING ELECTROSTATIC IMAGES

This application is a continuation of application Ser. No. 313,457, filed Feb. 22, 1989, which is now abandoned.

FIELD OF THE INVENTION AND RELATED ART

This invention relates to a toner for developing electrostatic images in an image forming method such as electrophotography, electrostatic recording and electrostatic printing, particularly to a dry magnetic toner improved in a hot roller fixing characteristic and an electrostatic image-developing characteristic.

In the prior art, a large number of electrophotographic processes have been known as described in U.S. Pat. No. 2,297,691 (corr. to Japanese Patent Publication (KOKOKU) No. 23910/1967 and U.S. Pat. No. 4,071,361 (corr. to Japanese Patent Publication No. 24748/1968. Generally speaking, in these processes, electrical latent images are formed on a photosensitive member of photoconductive substance by various means and subsequently developed by use of a toner, and the toner image is optionally transferred onto a transfer material such as paper, and then fixed by heating, pressurization, heating and pressurization, or with solvent vapor to obtain copied products. Then, the toner remaining on the photosensitive member without transfer is cleaned by various methods, and the above steps ar repeated.

In recent years, such copying apparatus are not only used as copying machines for office works for copying original manuscripts generally referred to, but they are also beginning to be used in the field of digital printers as output means of computers or as copying means for highly fine images for graphic design. Consequently, the performances demanded for toner have become severer, and more excellent machines do not fully exhibit their performances unless improvement in performance of toner can be accomplished.

With respect to the digital printer and printout or copying of highly fine images, most important performance among those required for a toner includes fixing characteristic (or fixability in thin lines, and developing reproducibility).

For example, various methods and devices have been developed concerning the steps of fixing toner images onto sheets such as paper, and the most general method currently available is the pressure heating system by hot rollers.

The pressure heating system performs fixing by permitting the toner image surface on the sheet to pass between the surfaces of hot rollers having the surface formed of a material having release characteristic for the toner while under contact therewith under pressure. This method effects contact between the surfaces of the hot rollers and the toner image on the sheet for fixing under pressure, and therefore heat efficiency when the toner image sticks onto the sheet for fixing is very good, and fixing can be very rapidly effected so that it is very effectively applied to high speed electrophotographic copying machines. However, according to the above method, sine the hot roller surfaces come into contact with the toner images under pressure under molten state, a part of the toner images may be attached and transferred onto the fixing roller surfaces, and the attached toner is then retransferred onto the next sheet to be fixed, whereby the so-called offset phenomenon may sometimes occur to contaminate the sheet to be fixed. One of the essential conditions for the hot roller fixing system has been accepted to prevent the hot fixing roller surface from attachment of toner.

On the other hand, in the latent image for a fine image, lines of electric force (or electric flux lines) are concentrated on the boundary between exposed and non-exposed portions, thereby to apparently increase a surface potential of a photosensitive member. Particularly, in a digital printer because the latent image comprises two-value basic pixels of ON-OFF, the lines of electric force are considerably concentrated on the boundary between exposed and non-exposed portions. Therefore, the amount of toner particles per unit area to be attached to a line latent image comprising basic pixels in a developing step is larger than that to be attached to an ordinary analogue latent image. As a result, in the fixing step for such images, there is demanded a toner having further improved fixability and anti-offset characteristic as compared with in the prior art. Because the amount of copied products for a printer is 3 to 5 times that for a copying machine at the same level (i.e., the same copying speed), there are also demanded high durability for development and high stability in images.

Concerning the technique for improvement of the binder resin for toner, for example, Japanese Patent Publication No. 23354/1976 (corr. to U.S. Pat. No. 3941898) proposes a toner by using a crosslinked polymer as the binder resin. While this method has an effect of improving anti-offset characteristic and anti-winding characteristic, on the other hand, fixing point is elevated by increasing the degree of the crosslinking, and therefore it is difficult to obtain a toner provided with sufficiently low fixing temperature, good anti-offset characteristic and anti-winding characteristic and sufficient fixability. Generally speaking, for improvement in fixability, the binder resin must be lowered in molecular weight to lower the softening point, which is antagonistic to the measure for improvement of anti-offset characteristic, an lowering in melting point will necessarily result in lowering in glass transition point of the resin, whereby undesirable phenomenon may also occur that the toner during storage suffers from blocking.

Further, concerning a toner comprising a low molecular weight polymer and a crosslinked polymer, for example, Japanese Laid-Open Patent Appln. (KOKAI) No. 86558/1983 proposes a toner comprising a lower molecular weight polymer and an infusible higher molecular weight polymer as the main resin components. According to this method, fixability tends to be improved, but because the weight-average molecular weight/number-average molecular weight (Mw/Mn) is as small as 3.5 or lower and the content of the insoluble and infusible higher molecular weight is so much as 40 to 90 wt. %, it is difficult to satisfy anti-offset characteristic, at a high level and practically it is extremely difficult to form a toner satisfying fixability (particularly, high speed fixing characteristic) and anti-offset characteristic unless a fixer having a device for feeding a liquid for prevention of offset is used.

Japanese Laid-Open Patent Appln. No. 166958/1985 proposes a toner comprising a resin composition component obtained by polymerization in the presence of a low molecular weight poly-α-methylstyrene with a number-average molecular weight (Mn) of 500 to 1,500. Particularly, in the above Laid-Open Patent Application, it is stated that the number-average molecular weight (Mn) in the range of 9,000 to 30,000 is preferable, but if Mn is increased for further improvement in anti-offset characteristic, fixability poses problems in practice and it is difficult to satisfy anti-offset characteristic at a high level.

Japanese Laid-Open Patent Appln. No. 16144/1981 (corr. to U.S. Patent No. 4499168) proposes a toner containing a binder resin component having at least one maximum value in the regions of molecular weights of $10^3$ to $8\times10^4$ and $10^5$ to $2\times10^6$, respectively, in the molecular weight distribution obtained by GPC (gel permeation chromatography). In this case, although anti-offset characteristic, anti-filming or anti-sticking onto a photosensitive member and image quality are excellent, further improvement in anti-offset characteristic and fixability is demanded. Particularly, it is difficult for to this resin maintain various other performances with further improvement in fixability, or respond to the severe requirements of today while improving such performances.

With respect to the above-mentioned thin-line reproducibility, particularly when a developer which has been used in the prior art is used in a digital copying machine as such, in a developing step, there often pose problems such that the image quality deteriorates due to toner scattering and line images are thinned under a high-humidity condition, because of the particularity of the line images. In addition, in a reversal development method which is ordinarily used for a digital copying machine using an organic photoconductor (OPC) drum, the amount of charges in the image portion of a latent image is much smaller than that in the non-image portion. Accordingly, when toner particles having unstable charges are present, there occurs a phenomenon of reversal fog such that toner particles are attached to the non-image portion having a large amount of charges.

As one of the causes for lowering the thinline reproducibility, there has been considered dispersion failure of an additive constituting a toner. Particularly, in the case of a one-component-type magnetic dry toner containing a magnetic material, it has been considered that the dispersibility of the magnetic material to be added thereto affects the developing characteristic of the toner.

Hitherto, with respect to improvement in the magnetic material used in toners, Japanese Laid-Open Patent Application No. 9153/1983 (corr. to U.S. Pat. No. 4450221) proposes a method wherein the surface of a magnetic material is treated with a treating agent such as titanium coupling agent and silane coupling agent to enhance the dispersibility of the magnetic material contained in a toner. In this case, while the dispersibility of the magnetic material in a binder resin is improved, the surface resistivity of the magnetic material becomes too high, whereby the environmental stability of the toner tends to decrease.

Japanese Patent Publication No. 27901/1984 (corr. to U.S. Pat. No. 4495268) discloses that in a magnetic material of a cubic system developing efficiency and image density are improved when the ratio of (bulk density/coercive force) is in the range of 0.0054–0.0129 g/ml-oersted, thereby to enhance the negative chargeability of a toner. In this case, however, the dispersibility of the magnetic material is not substantially considered. Therefore, such toner is not sufficiently effective in successive copying, and is not effective in the case of a negatively charged latent image on an OPC photosensitive member which is widely used at present.

Further, Japanese Laid-Open Patent Application No. 91242/1981 (corr. to U.S. Pat. No. 4485163) proposes that image density and image quality are improved by using a magnetic material having a bulk density of 0.45 g/ml or above, and an aliphatic carboxylic acid or its metal salt. However, it is considered that the aliphatic carboxylic acid or its metal salt is selectively attached to the surface of the magnetic material to increase the resistivity thereof. Accordingly, it is considered that such magnetic material is not sufficient for environmental stability and particularly for use in a high-speed machine.

As described above, there is desired a toner capable of satisfying both of fixing characteristic and thin-line reproducibility, particularly a toner capable of well developing a digital latent image.

SUMMARY OF THE INVENTION

An object of the present invention is to provide a toner which has solved the problems as described above.

Another object of the present invention is to provide a toner which is excellent in both fixability and anti-offset characteristic, excellent in image reproducibility, and free of reversal fog.

A further object of the present invention is to provide a toner which does not cause image deterioration even in long-term use.

A further object of the present invention is to provide a toner which can be fixed at low temperature, and yet is excellent in anti-blocking characteristic and particularly sufficiently useful in a high temperature atmosphere in a small copying machine.

A still further object of the present invention is to provide a toner which is excellent in anti-offset characteristic and can be produced with good efficiency.

In order to attain the above-mentioned object simultaneously, we have investigated various materials from various angles. As a result of such study, we have found that the above-mentioned objects are attained by combining a binder resin having a specific proportion of a THF (tetrahydrofuran)-insoluble and a THF-soluble having a specific molecular weight distribution; and a magnetic material having a specific bulk density and a specific shape.

According to the present invention, there is provided a magnetic toner for developing electrostatic images, comprising at least a binder resin and a magnetic powder; the binder resin having 10 to 70 wt. % of a THF (tetrahydrofuran)-insoluble and a THF-soluble, the THF-soluble providing a molecular weight distribution in the chromatogram of GPC (gel permeation chromatography) thereof such that it provides a rate (Mw/Mn) of weight-average molecular weight (Mw)/number-average molecular weight (Mn) $\geqq 5$, there are a peak in the molecular weight range of 2,000 to 10,000 and a peak or shoulder in the molecular weight range of 15,000 to 100,000, and a component having a molecular weight of 10,000 or smaller is contained in an amount of 10–50 wt. % based on the binder resin; the magnetic powder comprising spherical magnetic particles having a bulk density of 0.6 g/ml or larger.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
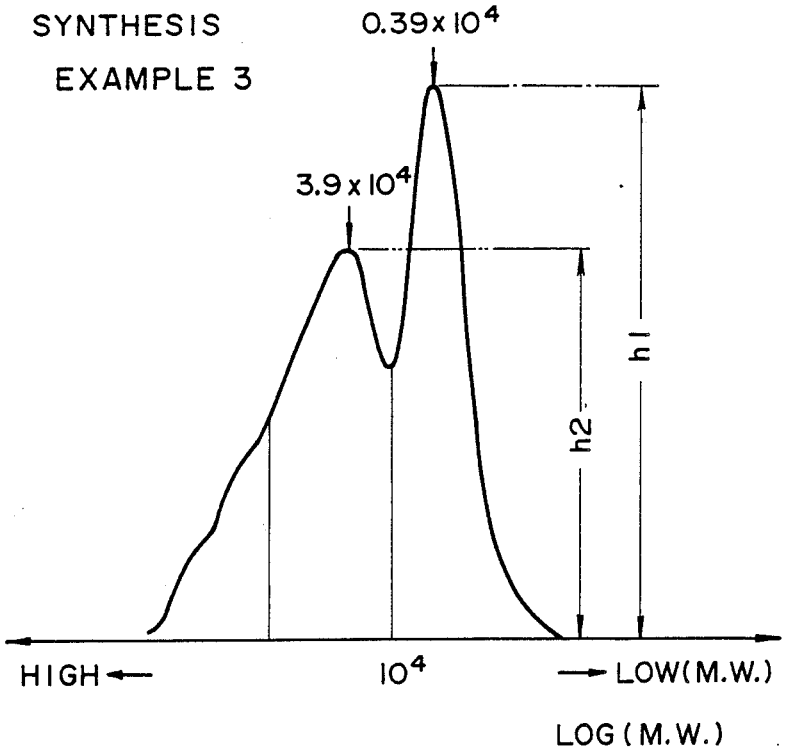
FIG. 1 shows a GPC chromatogram of the THF-soluble of the resin composition prepared in Synthesis Example 3.

In order to accomplish the objects as mentioned above at the same time, we have made an intensive study on compositions and performances of various binder resins from various viewpoints.

As a result, it has been found that in a binder resin system, the THF-insoluble influences primarily anti-offset characteristic and anti-winding characteristic basically, and that the components of molecular weights of 10,000 or less of THF-soluble influence primarily anti-blocking characteristic and anti-sticking or anti-filming characteristic onto a photosensitive member, and further that the amount of the components of molecular weights of 10,000 or more of THF-soluble influence primarily fixability. As a result, the proportion of the components of molecular weights of 10,000 or less may preferably be 10 to 50 wt. %, particularly 20 to 39 wt. %. For exhibiting sufficient performances, it is further required that the distribution should have a peak in the region of molecular weight of 2,000 to 10,000 (preferably 2,000–8,000) and a peak or a shoulder in the region of molecular weight of 15,000 to 100,000 (preferably 20,000–70,000). If there is no peak in the range of 2,000–10,000 and there is a peak at 2,000 or less, but the proportion of the components of molecular weight 10,000 or less in 50 wt. % or more, some problems may be caused in anti-blocking characteristic, anti-sticking or anti-filming characteristic onto a photosensitive member. If there is no peak at 10,000 or less, and there is a peak at 10,000 or more while the proportion of the components of molecular weight 10,000 or less is 10 wt. % or less, formation of coarse particles may pose a problem.

If there is no peak or shoulder in the region of molecular weight 15,000 or more and there is only a peak in the region of molecular weight 15,000 or less, anti-offset characteristic will pose a problem. If there is no peak or shoulder in the region of molecular weight 15,000–100,000, and there is the main peak at 100,000 or higher, pulverizability will pose a problem.

Further, the THF-soluble is required to satisfy the relationship of $Mw/Mn \geqq 5$, and if Mw/Mn is lower than 5, anti-offset characteristic tends to be lowered an problematic.

Preferably, Mw/Mn may be 80 or less, more preferably satisfy the relation of $10 \leqq Mw/Mn \leqq 60$.

Particularly, when Mw/Mn is $10 \leqq Mw/Mn \leqq 60$, especially excellent performances can be exhibited in various characteristics such as pulverizability, fixability, anti-offset characteristic, image quality, etc.

Here, Mw is weight-average molecular weight measured by GPC as described below, and Mn is number-average molecular weight by the same measurement.

The content of THF-insoluble in the binder resin for toner is 10 to 70 wt. %. If it is less than 10 wt. %, anti-offset characteristic becomes a problem, while at higher than 70 wt. %, the problem of deterioration due to cleavage of molecular chains during thermal kneading for preparation of toner may occur.

The content of THF-insoluble in the binder resin for toner may preferably be in the range of 15 to 49 wt. %, in view of anti-offset characteristic.

The THF-insoluble in the present invention represents a weight ratio of the polymer components (substantially crosslinked polymer) which have become insoluble in THF solvent in the resin composition in the toner, and can be used as a parameter indicating the extent of crosslinking of a resin composition containing crosslinked components. The THF-insoluble is defined by the value measured as described below.

A toner sample is weighed in an amount of 0.5 to 1.0 g ($W_1$ g), placed in a cylindrical filter paper (e.g., No. 86R, produced by Toyo Roshi K.K.) and subjected to a Soxhlet's extractor to effect extraction with the use of 100 to 200 ml of THF as the solvent for about 6 hours. The soluble extracted with the solvent is subjected to evaporation, and then vacuum-dried at 100° C. for several hours, and the amount of the THF-soluble resin component is weighed ($W_2$ g). The weight of the components other the resin component such as magnetic material or pigment in the toner is defined as ($W_3$ g). The THF-insoluble is defined from the following formula:

$$\text{THF-insoluble (\%)} = \frac{W1 - (W3 + W2)}{(W1 - W3)} \times 100$$

In the present invention, the molecular weight of a peak or/and a shoulder in a chromatogram by GPC (gel permeation chromatography), may be measured under the following conditions.

Through a column stabilized in a heat chamber at 40 ° C., THF (tetrahydrofuran) as the solvent is permitted to flow at a rate of 1 ml/min., and 50 to 200 μl of a THF sample solution of a resin controlled to a sample concentration of 0.05 of 0.6 wt. % is injected for measurement. I measuring the molecular weight of the sample, the molecular weight distribution possessed by the sample is calculated based on a calibration curve prepared from several kinds of mono-dispersed polystyrene standard samples showing a relationship between the logarithmic value of the molecular weights and the count numbers. As the standard polystyrene samples for preparation of the calibration curve, for example, those produced by Pressure Chemical Co. or Toyo Soda Kogyo K.K., having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, $4.48\times10^6$ may be employed, and it is suitable to use at least 10 points of standard polystyrene samples. As the detector, an RI (refractive index) detector is used.

As the column, for measuring adequately a molecular region of $10^3-4\times10^6$, a plurality of commercially available polystyrene gel columns may be preferably combined. For example, a combination of *-styragel 500, $10^3$, $10^4$ and $10^5$ produced by Waters Co., a combination of Shodex KF-80M, KF-802, 803, 804 and 805 produced by Showa Denko K.K., or a combination of TSKgel G1000H, G2000H, G2500H, G3000H, G4000H, G5000H, G6000H, G7000H and GMH produced by Toyo Soda K.K., are preferred.

The weight % of the components of molecular weights 10,000 or lower relative to the binder resin is determined by cutting out the portion of chromatogram corresponding to the components of molecular weights of 10,000 or less, calculating the weight ratio relative to the portion of chromatogram cut out corresponding to the components of 10,000 or more, and calculating the weight % relative to the whole resin by use of the weight % of the above THF-insoluble.

When the glass transition point $Tg_1$ of the resin of the molecular weight components of 10,000 or less in the THF-soluble is compared with the $Tg_t$ of the whole resin, if the relationship of $(Tg_1)\geqq(Tg_t-5)$ is satisfied, fixability, pulverizability, anti-sticking, anti-filming characteristic onto a photosensitive member, inhibition of sticking on inner walls of a pulverizer, and anti-blocking characteristic will become better. $Tg_1$ may preferably be 55 °C. or higher.

$Tg_1$ as herein mentioned is measured by the following method. Under THF flow at a rate of 7 ml/min. at 25 ° C., a sample solution in THF with a concentration of about 3 mg/ml of THF-soluble in toner is injected in an amount of about 3 ml into a molecular weight distribution measuring apparatus, and the components of molecular weights of 10,000 or less are separated and collected. After collection, the solvent is evaporated under reduced pressure and further dried in an atmosphere of 90 ° C. under reduced pressure for 24 hours. The above operation is repeated until about 20 mg of the components with molecular weights of 10,000 or less is obtained. The obtained sample is subjected to annealing at 50 ° C. for 48 hours, and thereafter Tg is measured by differential scanning calorimetry (DSC), and the measured value is defined as $Tg_1$.

The measurement used herein is conducted according to ASTM D3418-82 which is generally known.

More specifically, the sample temperature is elevated at a temperature increasing rate of 10 ° C./min. up to 120 ° C. or higher, and is retained for about 10 min. at this temperature. Then, the sample temperature is rapidly cooled to 0 ° C., and is retained for 10 min. at this temperature. Thereafter, the sample temperature is elevated at a temperature increasing rate of 10 ° C./min. to obtain an endothermic curve (i.e., thermal characteristic curve). Based on such measurement, Tg is defined as the temperature corresponding to the midpoint between the intersection of a first base line and the thermal characteristic curve (before inflection) obtained by the DSC, and the intersection of a second base line and, the thermal characteristic curve (after the inflection).

As the column for separation, column such as TSKgel G2000H, TSKgel G2500H, TSKgel G3000, TSKgel G4000H 8produced by Toyo Soda Kogyo K.K.) may be employed, but in the present invention, TSKgel G2000H and TSKgel G3000H were employed in combination.

The value of $Tg_t$ which is the Tg of a resin is determined by differential scanning calorimetry after subjecting the resin to annealing at 50 ° C. for 48 hours.

According to a most preferred embodiment of the present invention, there is provided a toner containing a binder resin or resin composition, having a ratio of $h_1/h_2$ of 0.4/1 to 4.0/1, when the height of the highest peak in the region of molecular weight of 15,000 to 100,000 is denoted by $h_2$ and the height of the highest peak in the region of molecular weight of 2,000 to 10,000 is denoted by $h_1$ in the GPC molecular weight distribution of THF-soluble, as shown in FIG. 1.

The magnetic toner according to the present invention may preferably be prepared by mixing (i) a specific binder resin as follows with (ii) a magnetic material having a bulk density of 0.6 g/ml or above in their powder states, thermally kneading, and pulverizing the kneaded product.

A preferred binder resin used herein comprises substantially spherical particles or aggregates thereof, has an average particle size of 0.1–0,7 mm, and comprises 10–70 wt. % of a THF-insoluble and a THF-soluble; wherein the THF-soluble provides a molecular weight distribution in the chromatogram of GPC (gel permeation chromatography) thereby such that a ratio Mw/Mn (weight-average molecular weight)/(number-average molecular weight) of 5.0 or larger and there are at least one peak in the molecular weight range of 2,000 to 10,000 and at least one peak or shoulder in the molecular weight range of 15,000 to 100,000 and a component having a molecular weight of 10,000 or smaller is contained in the binder resin in an amount of 10–50 wt. %.

The above-mentioned resin particles, as the material for the toner of the present invention, may preferably comprise substantially spherical particles or aggregates thereof. In general, such particles may easily be produced by suspension polymerization using a dispersion medium and a dispersed phase. Such resin powder has an advantage that it has good fluidity and is easy to handle, and may provide good production efficiency because it does not require a step of pulverizing a mass into fine powder, unlike solution polymerization or bulk polymerization.

However, the above-mentioned spherical resin powder is somewhat problematic when used as such as the material for a toner. More specifically, there occurs a problem such that the resin powder has a fluidity and a specific gravity which are very different from those of a magnetic material, and therefore the resin powder is not sufficiently mixed with the magnetic material in their powder states before thermal kneading. When a resin known in the prior art is used, such poor mixing can be compensated to obtain a toner applicable to ordinary use. However, we have found that such conventional concept is insufficient to provide a toner having high durability.

In other words, when there is used a binder resin containing a crosslinked component and 10–50 wt. % of a low-molecular weight component having a molecular weight of 10,000 or below, it is considered necessary that another material is incorporated and dispersed even in the low-molecular weight portion which is present in the crosslinked network structure. Accordingly, it is considered necessary that the respective materials are uniformly mixed with each other sufficiently in their powder states prior to the thermal kneading.

As a result of our investigation, we have found that when the resin particles have an average particle size of below 0.10 mm, their bulk becomes larger and they are less liable to be dispersed; a large amount of dispersant such as polyvinyl alcohol and calcium phosphate is necessarily used in order to reduce the particle size, whereby the electrostatic characteristic of the resultant toner, particularly the environmental characteristic, tends to deteriorate. When the average particle size is larger than 0.7 mm, the mixability of the resin particles with a magnetic material, etc., in powder mixing becomes poor to cause a decrease in long-term durability. The average particle size of the resin particles may preferably be 0.10–0.7 mm, more preferably 0.15–0.4 mm.

The average particle size used herein refers to a 50 wt. % - diameter (hereinafter, referred to as "$D_{50\%}$") in a cumulative distribution curve (i.e., the particle size corresponding to the cumulative weighth of 50 % in the cumulative distribution curve) obtained by using a sieve.

In a further preferred embodiment, a 10-% diameter in the cumulative distribution curve (hereinafter, referred to "$D_{10\%}$", et seq.) may preferably be 0.09–0.4 mm, more preferably 0.1–0.2 mm; $D_{20\%}$ may preferably be 0.12–0.5 mm, more preferably 0.13–0.25; the range of $D_{30\%}$ to $D_{50\%}$ may preferably be included in the range of 0.15–0.7 mm, more preferably 0.15–0.4 mm; the range of D60% to $D_{80\%}$ may preferably included in the range of 0.15–0.8 mm, more preferably 0.25–0.7 mm; and the range of $D_{90\%}$ to $D_{100\%}$ may preferably be included in the range of 0.2–0.8 mm, more preferably 0.5–0.8 mm. The content of a component of 20 mesh-on may preferably be 10 wt. % or less, more preferably 5 wt. % or less.

The above-mentioned particle size distribution may be measured by using a Ro-Tap shaker equipped with JIS standard sieves of 20, 42, 60, 80, 100 and 200 mesh, and 33 g of a sample, at a vibration speed of 290 rpm and a vibration tim of 330 sec.

The binder resin used in the present invention may be any of those which are generally usable as a binder resin for a toner and capable of providing the above-mentioned molecular weight distribution. Among these, there may preferably used vinyl-type polymers or copolymers using one or more vinyl monomers, and compositions of these polymers and/or copolymers.

The resin composition in the toner of the present invention may be preferably polymers or copolymers obtained by polymerization of at least one monomer selected from styrene type monomers, acrylic acid type monomers, methacrylic acid type monomers and derivatives thereof in view of developing characteristics and charging characteristics. Examples of the monomers may include styrene or substituted derivatives thereof such as styrene, α-methylstyrene, p-chlorostyrene and the like; monocarboxylic acids having a double bond and their substituted derivatives, such as acrylic acid, methyl acrylate, ethyl acrylate, butyl acrylate, dodecyl acrylate, octyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and their substituted derivatives, such as maleic acid, butyl maleate, methyl maleate, and dimethyl maleate; vinyl esters, such as vinyl chloride, vinyl acetate, and vinyl benzoate; ethylenic olefins, such as ethylene, propylene, and butylene; vinyl ketones, such as vinyl methyl ketone, and vinyl hexyl ketone; vinyl ethers, such as vinyl methyl ether, vinyl ethyl ether, and vinyl isobutyl ethers. These monomers may be used singly or as a combination of two or more species. Among these, there may particularly preferably be used a combination of a styrene-type polymer and a styrene type copolymer.

In the preparation of the resin used in the present invention, it is important to select the kind of an initiator or solvent, and reaction conditions, in order to obtain a resin suitably used in present invention. Examples of the initiator may include: organic peroxides such as 1,1-di-(t-butylperoxy)-3,3,5-trimethyl-cyclohexane, n-butyl-4,4-di-(t-butylperoxy) volerate, dicumyl peroxide, α,α'-bis(t-butylperoxydiisopropyl)benzene, t-butyl-peroxycumene, and di-t-butyl peroxide; and azo or diazo compounds such as azobusisobutyronitrile and diazoaminoazobenzene.

As the crosslinking monomer or crosslinking agent, a compound having two or more polymerizable double bonds may principally be used. Examples thereof include: aromatic divinyl compounds, such as divinylbenzene, and divinylnaphthalene; carboxylic acid esters having two double bonds, such as ethylene glycol diacrylate, ethylene glycol dimethacrylate, and 1,3-butanediol diacrylate; divinyl compounds such as divinylaniline, divinyl ether, divinyl sulfide and divinyl sulfone; and compounds having three or more vinyl groups. These compounds may be used singly or in mixture. Among these, divinylbenzene may particularly preferably be used.

The binder resin according to the present invention may preferably have a glass transition point in the range of 40°–80 ° C., while it shows considerably different glass transition points depending on the kind or composition of the monomer constituting it. A glass transition point of 50°–65 ° C. is further preferred in view of anti-blocking characteristic and fixability. If the glass transition point is lower than 40 ° C., thermal agglomeration or caking is extremely liable to occur in toner storage, whereby agglomeration trouble is liable to occur in a copying machine. On the other hand, if the glass transition points is higher than 80 ° C., thermal fixing efficiency is lowered.

In a method for preparing the binder resin according to the present invention, a first resin is prepared by solution polymerization, the first resin is dissolved in a polymerizable monomer and the polymerizable monomer is suspension-polymerized in the presence of the first resin and a crossliking agent. It is preferable to dissolve 10 to 120 parts by weight, preferably 20 to 100 parts by weight of the first resin per 100 parts by weight of the monomer for suspension polymerization. During the suspension polymerization, it is preferable to use about 0.1 to 2.0 wt. % of a crosslinking agent based on the monomer to be suspension-polymerized. Slight change in these conditions may be tolerable depending on the kind of initiator and the reaction temperature.

It has been found that a binder resin obtained by dissolving a first polymer in a monomer followed by suspension polymerization of the monomer is different from a blended polymer obtained by mere mixing of the first polymer and a polymer obtained by suspension polymerization of the monomer without dissolving the first polymers.

The difference resides in the point that the former is slightly ricker in high molecular weight components in the chromatogram of GPC of THM-soluble than the latter, giving a broader molecular weight distribution. The former comprises molecular weights of $30\times10^4$ or more at a ratio of 3 to 25 wt. % of the whole resin, which is clearly greater than that of the latter. This may be attributable to the fact that the first polymer dissolved influences suspension polymerization, which provides an advantageous effect not attainable by homogeneous mixing of the polymers. This is described in more detail by referring to the GPC charts shown in the accompanying drawings.

Figure 2:
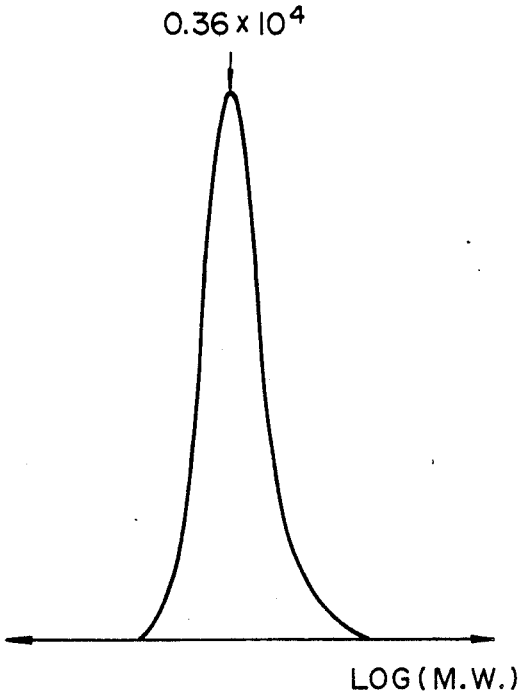
FIG. 2 shows a GPC chromatogram of THF-soluble of the polystyrene used in Synthesis Example 3.
Figure 3:
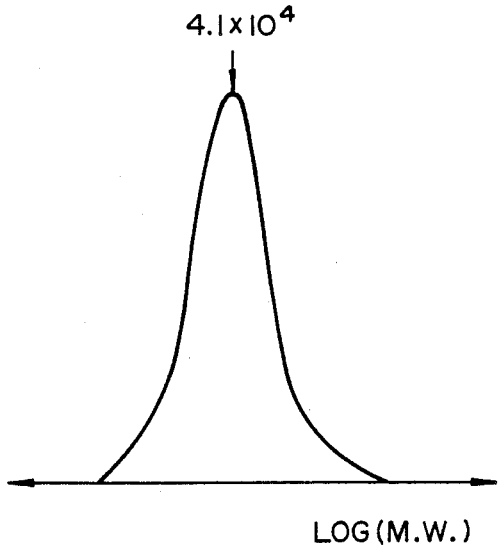
FIG. 3 shows a GPC chromatograph of THF-soluble of the copolymer obtained when the styrene-n-butyl acrylate copolymer in Synthesis Example 3 was suspension-polymerized alone.

FIG. 1 in the accompanying drawings shows a chart of GPC of the THF-soluble of a resin composition obtained in Synthesis Example 3 as described below. FIG. 2 shows a chart of GPC of a polystyrene prepared in solution polymerization which is a first polymerization. The polystyrene was soluble in THF, and also soluble in styrene monomer and n-butyl acrylate monomer which were polymerization monomers, and had a main peak at a molecular weight of 3,600. FIG. 3 shows a chart of GPC of THF-soluble of the product formed by suspension polymerization of a styrene-n-butyl acrylate copolymer prepared in the second polymerization under the same conditions except that the polystyrene was not added. The styrene-n-butyl acrylate copolymer was found to have a main peak at a molecular weight of 41,000.

Figure 4:
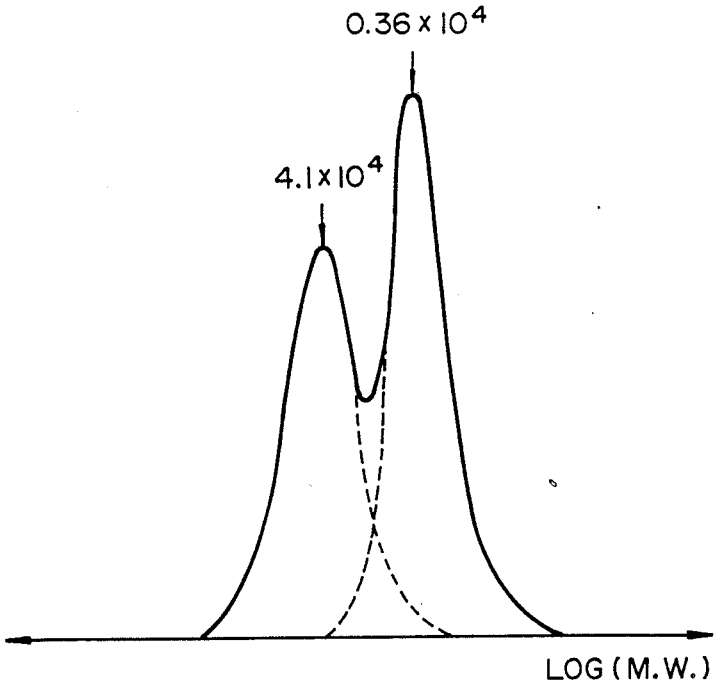
FIG. 4 is a combined chart of the chart in FIG. 2 and the chart in FIG. 3.

FIG. 4 is a combination of the chart in FIG. 2 and the chart in FIG. 3.

Figure 5:
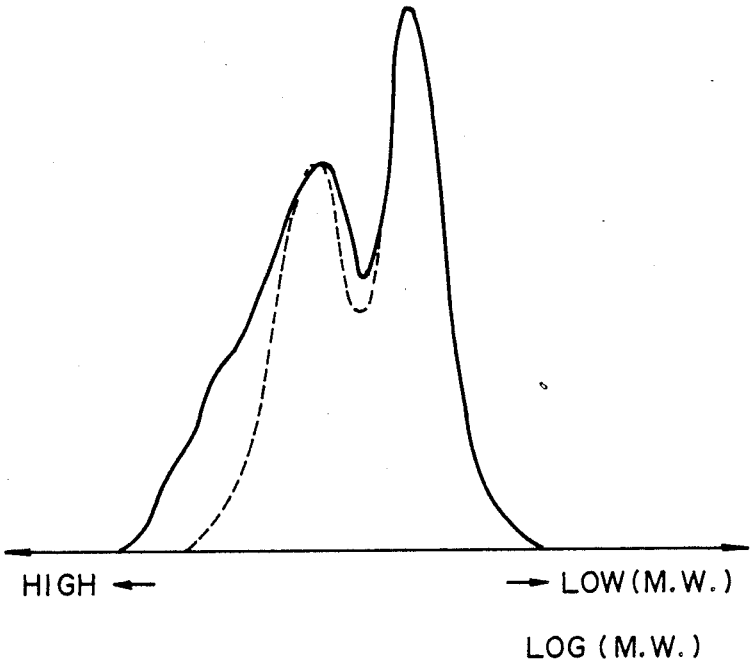
FIG. 5 is a chart prepared by overlapping the chart in FIG. 1 (solid line) with the chart in FIG. 4 (broken line) for comparative purpose.

FIG. 5 shows a superposition of the chart in FIG. 1 and the chart in FIG. 4 (converted into a broken). As is also apparent from FIG. 5, the resin composition obtained in Synthesis Example 3 according to the present invention was found to have a GPC chart which was different from that of the product obtained by merely mixing the polystyrene and the styrene-n-butyl acrylate copolymer separately polymerized. Particularly, on the higher molecular side, a polymer component not formed in the styrene-n-butyl acrylate copolymer alone is found to be formed. This higher molecular weight component may be considered to be formed by the presence of the polystyrene prepared in the first step solution polymerization during the suspension polymerization which is the second step polymerization, with the polystyrene functioning as the polymerization controller, whereby synthesis of THF-insoluble and THF-soluble of styrene-n-butyl acrylate copolymer is controlled. In the resin composition according to the present invention, THF-insoluble, high molecular components soluble in THF, intermediate molecular weight components soluble in THF and low molecular weight components soluble in THF, are homogeneously mixed. Further, the resin composition according to the present invention has an ability of forming a new peak in the region of the molecular weights of $30\times10^4$ or higher (preferably $50\times10^4$ or higher) through cleavage of molecular chains in the melting and kneading step during preparation of toner, to control fixability and anti-offset characteristic of the toner.

Further, in the present invention, it is preferable that the components of molecular weights of $30\times10^4$ or more is contained in an amount of 5 to 30 wt. % (preferably 10 to 30 wt. %) of the binder resin based on GPC of THF-soluble in the toner. In GPC of THF-soluble in toner, a binder resin having a clear peak at molecular weights of $30\times10^4$ or higher (preferably $50\times10^4$ or higher) is more preferable with respect to improvement in anti-offset characteristic and anti-winding characteristic.

The solution polymerization process and the suspension polymerization process according to the present invention are described below.

As the solvent to be used in the solution polymerization, xylene, toluene, cumene, cellosolve acetate, isopropyl alcohol, benzene, etc. may be employed. In the case of a styrene monomer, xylene, toluene or cumene is preferred. It may be suitably selected depending on the polymer formed. The initiator may include di-tert-butylperoxide, tert-butyl peroxybenzoate, benzoyl peroxide, 2,2'-azobisisobutyronitrile, 2,2'-azobis(2,4-dimethylvalenonitrile), etc., which may be used at a concentration of 0.1 part by weight or more (preferably 0.4 to 15 parts by weight) based on 100 parts by weight of the monomer. The reaction temperature, which may depend on the solvent, the initiator employed and the polymer to be polymerized, may be preferably 70 ° C. to 180 ° C.. In the solution polymerization, it is preferable to use 30 parts to 400 parts by weight of the monomer per 100 parts by weight of the solvent.

In the suspension polymerization, it is preferable to use 100 parts by weight or less (preferably 10 to 90 parts by weight) of the monomer per 100 parts by weight of an aqueous dispersion medium. Available dispersing agents may include polyvinyl alcohol, partially saponified polyvinyl alcohol, or calcium phosphate, etc., and may be used in an amount of 0.05 to 1 part by weight (preferably 0.1–0.5 part by weight) based on 100 parts by weight of the aqueous dispersion medium as an appropriate amount while it may somewhat depends on the amount of the monomer relative to the aqueous dispersion medium.

It is preferred that a resin composition comprising spherical particles having a prescribed particle size (e.g., an average particle size of 0.1–0.7 mm) are obtained by controlling the amount of a dispersant such as polyvinyl alcohol and by using a stirrer having a stirring vane which has a shape suitable for providing strong stirring force.

The polymerization temperature may be appropriately 50 to 90 ° C., and it should be selected suitably depending on the initiator employed and the desired polymer. Also, although any kind of initiator can be used so long as it is insoluble or hardly soluble in water, for example, benzoyl peroxide or tert-butylperoxide hexanoate, or a mixture of these may be used in an amount of 0.5 to 10 parts by weight based on 100 parts by weight of the monomer.

In the toner using the resin of the present invention, in addition to the above binder resin component, the following components may be incorporated at a ratio smaller than the content of the binder resin component, within the range which does not adversely affect the effect of the present invention.

For example, there may be added silicone resin, polyester, polyurethane, polyamide, epoxy resin, polyvinyl butyral, rosin, modified rosin, terpene resin, phenol resin, aliphatic or alicyclic hydrocarbon resin such as low-molecular weight polyethylene or low-molecular weight polypropylene, aromatic petroleum resin, chlorinated paraffin, paraffin wax, and others.

In the present invention, it is necessary to select a magnetic material which can be well dispersed in a binder resin containing a gel content. The magnetic material used in the present invention has a bulk density of 0.6 g/ml or larger, preferably 0.7 ml/g or larger, more preferably 0.8 g/ml or larger, particularly preferably 0.9 g/ml to 1.5 g/ml. If the bulk density is smaller than 0.6 g/ml, the magnetic material is not sufficiently dispersed in the toner and is localized, whereby sufficient thin-line reproducibility cannot be obtained.

As the spherical magnetic material, there may preferably be used one comprising 70 % by number or more (more preferably 80 % by number or more) of spherical or substantially spherical magnetic particles which has a ratio of (longer axis/shorter axis) of 1.2 or smaller.

On the other hand, a magnetic material of cubic system may cause some troubles, while it can increase its bulk density under prescribed treatment. The reason for the above-mentioned sequence of phenomenon may be considered as follows:

Because the angles of the magnetic powder of cubic system are very easily broken under stress, they are broken in the treatment for enhancing a bulk density to produce fine magnetic powder. When a toner is prepared by using such magnetic material, the fine powder of the magnetic material cannot be uniformly dispersed in toner particles, whereby it is difficult to obtain a toner having good developing characteristic. Further, because the magnetic material of cubic system has a particularly large residual magnetization (hereinafter, referred to as "$\sigma_r$") among its magnetic characteristics, the toner obtained by using such magnetic material has strong magnetic cohesion. Accordingly, the toner particles sometimes do not function as independent particles, thereby to decrease the image quality. Such decrease in image quality becomes remarkably noticeable to cause a serious problem, particularly when a digital latent image due to laser etc., is developed with the above-mentioned toner.

Incidentally, in order to enhance the bulk density, there may be utilized a technique using a machine such as a Fret mill. The bulk density (g/cc) or (g/ml) used herein refers to a value measured according to JIS (Japanese Industrial Standard) K 5101.

In the above-mentioned resin composition capable of providing high fixability, a low-molecular weight component is microscopically present among the network structure of a crosslinked component. Accordingly, such resin composition has a relatively small bulk density and therefore has poor mixability with a magnetic material holding a large amount of air among magnetic particles thereof. As a result, it is difficult to sufficiently mix the low-molecular weight component with the magnetic material.

Incidentally, when the bulk density of a magnetic material of cubic system originally having a small bulk density of 0.3 g/ml is intended to be increased by means of a machine such as a Fret mill, the bulk density can be increased at most to about 0.5 g/ml, which is still insufficient. However, because the spherical magnetic particles have a bulk density of about 0.45 g/ml, they may easily provide a bulk density of 0.6 g/ml or larger when subjected to treatment for enhancing the bulk density, and may provide a toner having high durability which is capable of providing high-quality images.

Particularly, in the reversal development of a digital latent image formed on an OPC photosensitive member, there may be prepared a toner having high durability which is capable of providing images substantially without or with very little reversal fog. The reason for this may clearly be considered that the dispersibility has been improved. A further high bulk density may provide a further high dispersibility.

Incidentally, spherical magnetic particles have a small residual magnetization ($\sigma_r$) of 5 emu/g or below, and a small coercive force (Hc) of 60 Öe or below.

The magnetic material with spherical shapes to be contained in the magnetic toner of the present invention may include iron oxides such as magnetite, hematite, ferrite or compounds of divalent metal and iron oxide; metal such as iron, cobalt, nickel or alloys of these metals with metals such as aluminum, cobalt, copper, lead, magnesium, tin, zinc, antimony, beryllium, bismuth, cadmium, calcium, manganese, selenium, titanium, tungsten, vanadium, and mixtures thereof.

The spherical magnetic particles may preferably have an average particle size of 0.1 to 1 micron, preferably 0.1 to 0.5 micron. The amount thereof contained in the toner may preferably be about 40 to 200 parts by weight based on 100 parts by weight of the binder resin, particularly preferably 50 to 150 parts by weight based on 100 parts by weight of the binder resin, in view of the fixability and triboelectric chargeability of the magnetic toner.

The magnetic toner of the present invention may further contain a charge controller as desired. Examples of the charge controller may include; dyes or pigments such as nitrohumic acid and salts thereof or Color Index (C.I.) 14645 as disclosed in Japanese Laid-Open patent Application No. 133338/1975: Zn, Al, Co, Cr or Fe metal complexes of salicylic acid, naphthoic acid, discarboxylic acid; sulfonated copper phthalocyanine pigments; styrene oligomers having nitrile group or halogen introduced therein, and chlorinated paraffins, as disclosed in Japanese Patent Publication Nos. 42752/1980, 41508/1983, 7384/1983 and 7384/1984. Particularly, from the aspect of dispersibility,metal complexes (or metal salts) of monoazo dyes, metal complexes (or metal salts) of salicylic acid, alkylsalicylic acid, dialkylsalicylic acid, naphthoic acid, dicarboxylic acid are preferred.

We have found that a negative charge controller of a monoazo-type provides further improved dispersibility and image quality. The reason for such phenomenon is not necessarily clear but may be considered that the monoazo-type compound has certain interaction with the decomposition product of a polymer or groups present at the terminals of polymer chains, and magnetic particle having the charge controller attached thereto on their surfaces are well dispersed in binder resin.

Particularly preferred examples of the monoazo-type compound may include those represented by the following formulas. The monoazo-type compound may preferably be used in an amount of 0.1–5 wt. parts per 100 wt. parts of a binder resin, in view of negative charge-controlling characteristic and prevention of sleeve contamination.

(CA-1)

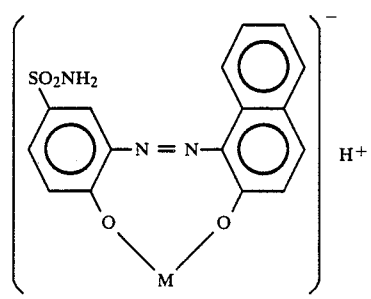

-continued (CA-2)

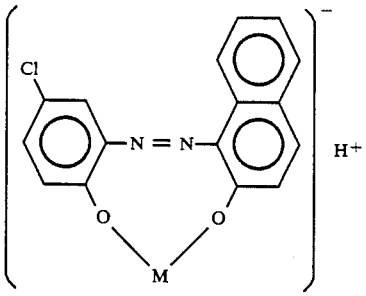

(CA-3)

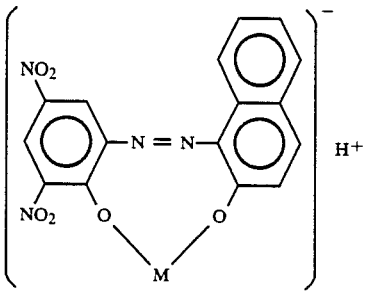

(CA-4)

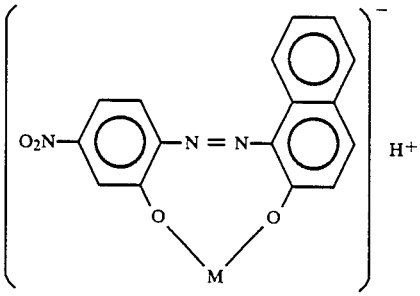

(CA-5)

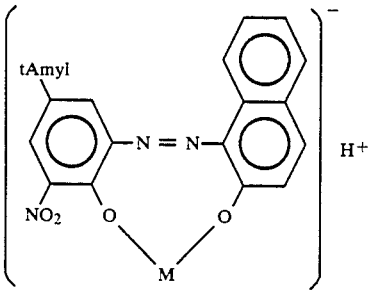

(CA-6)

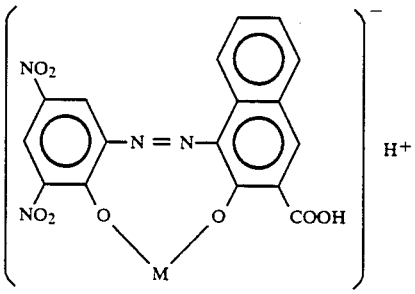

In the above formulas, M denotes Cr, Fe, Co or Al.

The toner of the present invention can be also mixed with other additives, if desired, to give good results. Examples of such additives may include lubricants such as Teflon, zinc stearate, polyvinylidene fluoride (among them, polyvinylidene fluoride is preferred); abrasives such as cerium oxide, silicon carbide, strontium titanate (among them, strontium titanate is preferred); flowability-imparting agents such as colloidal silica is particularly preferred); caking preventives; conductivity-imparting agents such as carbon black, zinc oxide, antimony oxide, tin oxide; fixing aids such as low-molecular weight polyethylene, low-molecular weight polypropylene, various waxes; or anti-offset agents. It is also possible to use a small amount of white fine particles and black fine particles of the opposite polarity as the developability improving agent.

The present invention is described in detail below by referring to Synthesis Examples and Examples. In the following formulations, "parts" are parts by weight.

SYNTHESIS EXAMPLE 1

Into a reactor, 200 parts by weight of cumene were charged and the temperature was raised to the reflux temperature. To this was added dropwise a mixture of 100 parts by weight of styrene monomer and 8.5 parts of di-tert-butyl peroxide under cumene reflux over 4 hours. Further, under cumene reflux, solution polymerization was completed (146°–156 ° C.), and cumene was removed. The polystyrene obtained was found to be soluble in THF, with Mw =3,500, Mw/Mn =2.52, and the main peak of GPC was positioned at a molecular weight of 3,300, with Tg=56 ° C.

The above polystyrene (30 parts by weight) was dissolved in the monomer mixture shown below to provide a mixed solution.

| Monomer mixture | Formulated ratio |
|---|---|
| Styrene monomer | 55 wt. parts |
| n-Butyl acrylate monomer | 15 wt. parts |
| Divinylbenzene | 0.26 wt. parts |
| Benzoyl peroxide | 1 wt. parts |
| tert-Butylperoxy-2-ethyl-hexanoate | 0.7 wt. parts |

Into the above mixed solution, 170 parts by weight of water containing 0.1 part by weight of a partially saponified polyvinyl alcohol dissolved therein were added to form a suspension.

The above suspension was added into a reactor equipped with a stirrer for stirring by use of high shear force which had been charged with 15 parts by weight of water and replaced with nitrogen, and suspension polymerization was carried out at a reaction temperature of 70° to 95 ° C. for 6 hours at a rotating speed of the stirring vane of 270 rpm. After completion of the reaction, the product was filtered off, dehydrated and dried to give a composition of a polystyrene and a styrene-n-butyl acrylate copolymer. This composition contained THF-insoluble and THF-soluble homogeneously mixed therein, and the polystyrene and the styrene-n-butyl acrylate copolymer were found to be homogeneously mixed. The thus obtained composition comprised spherical particles and aggregates thereof, had a particle size of 0.3 mm in terms of 50 %-diameter in the cumulative distribution curve ($D_{50\%}$, and contained 3 wt. % of resin particles of 20 mesh-on. The content of the THF-insoluble (measured as the powder of 24 mesh pass, 60 mesh on) was 36 wt. %.

The molecular weight distribution of the THF-soluble was measured to give a result that there were peaks at the positions of about $0.37\times10^4$ and about $3.3\times10^4$ in the GPC chart, with $Mn=0.53\times10^4$, $Mw=12.6\times10^4$, $Mw/Mn=23.8$, and the molecular weight of $10^4$ or lower being 25 wt. %. Further, Tg of the resin was 58 ° C., and the glass transition point $Tg_1$ of the components of $10^4$ or less separated by GPC was 56 ° C.

The characteristics concerning molecular weights of the respective resins and resin compositions were measured according to the following method.

By use of Shodex KF-80M as the column for GPC measurement, it was assembled in the heat chamber of 40 ° C. of a GPC measuring device (150C ALC/GPC produced by Waters Co.), and GPC operation was effected by injecting 200 μl of a sample (about 0.1 wt. % concentration of THF-soluble) under the condition of THF flow rate of 1 ml/min. and by using an RI for the detector. As the calibration curve for molecular weight measurement, THF solutions of mono-dispersed polystyrene standard materials (produced by Waters Co.) of the 10 points of molecular weights of $0.5\times10^3$, $2.35\times10^3$, $10.2\times10^3$, $35\times10^3$, $110\times10^3$, $200\times10^3$, $470\times10^3$, $1200\times10^3$, $2700\times10^3$ and $8420\times10^3$ were used.

SYNTHESIS EXAMPLE 2

Into a reactor, 150 parts by weight of cumene was charged, and the temperature was raised to the reflux temperature. The following mixture was added dropwise under cumene reflux over 4 hours.

| Monomer mixture | Formulated ratio |
|---|---|
| Styrene monomer | 98 wt. parts |
| n-Butyl acrylate monomer | 2 wt. parts |
| Di-tert-butyl peroxide | 4.2 wt. parts |

Further, polymerization was completed under cumene reflux (146°-156 ° C.) and cumene was removed. The styrene-n-butyl acrylate copolymer obtained had Mw =6,800, Mw/Mn =2.24 a main peak at a molecular weight of 7,000, and Tg =63 ° C.

The above styrene-n-butyl acrylate copolymer (40 parts by weight) wa dissolved in the following monomer mixture to provide a mixture.

| Monomer mixture | Formulated ratio |
|---|---|
| Styrene monomer | 36 wt. parts |
| n-Butyl methacrylate monomer | 24 wt. parts |
| Divinylbenzene | 0.25 wt. parts |
| Benzoyl peroxide | 0.65 wt. parts |
| tert-Butylperoxy-2-ethyl-hexanoate | 0.85 wt. parts |

Into the above mixed solution, 170 parts by weight of water containing 0.1 part by weight of a partially saponified polyvinyl alcohol dissolved therein were added to form a suspension.

The above suspension was added into a reactor charged with 15 parts by weight of water and replaced with nitrogen, and suspension polymerization was carried out at a reaction temperature of 70° to 95 ° C. for 6 hours in the same manner as in Synthesis Example 1. After completion of the reaction, the product was filtered off, dehydrated and dried to give a composition of a polystyrene and a styrene-n-butyl acrylate copolymer and a styrene-n-butyl methacrylate copolymer.

The thus obtained composition comprised spherical particles and aggregates thereof, had a particle size of 0.28 mm in terms of 50 %-diameter in the cumulative distribution curve, and contained 4 wt. of resin particles of 20 mesh-on.

The content of the THF-insoluble (measured as the powder of 24 mesh pass, 60 mesh on) was 35 wt. %. The molecular weight distribution of the THF-soluble was measured to give a result that there were peaks at the positions of about 7,000 and about 30,000 in the GPC chart, with Mn =6,300, Mw =140,000, Mw/Mn =22.2 and the molecular weights of $10^4$ or lower being 37 wt.%. Further, Tg of the resin was 61 ° C., and the glass transition point $Tg_1$ of the components of $10^4$ or less separated by GPC was 61 ° C.

COMPARATIVE SYNTHESIS EXAMPLE 1

The polystyrene obtained in Synthesis Example 1 (30 parts by weight) was dissolved in the following monomer mixture to provide a mixed solution.

| Monomer mixture | Formulated ratio |
|---|---|
| Styrene monomer | 54 wt. parts |
| n-Butyl acrylate monomer | 16 wt. parts |
| Divinylbenzene | 0.13 wt. parts |
| tert-Butylperoxyhexanoate | 1.0 wt. parts |

The above mixture was subjected to suspension polymerization in the same manner as in Synthesis Example 1 except that 0.05 wt. part of polyvinyl alcohol was used and the rotating speed of the stirring vane was 50 rpm, to obtain a composition of a polystyrene and a styrene-n-butyl acrylate copolymer. In the GPC chromatogram of the THF-soluble of this composition, there were peaks at the positions of a molecular weight of about 4,000 and a molecular weight of $15\times10^4$. The thus obtained composition comprised spherical particles and aggregates thereof, had a particle size of 0.8mm in terms of 50 %-diameter in the cumulative distribution curve, and contained 12 wt. % of resin particles of 20 mesh-on.

SYNTHESIS EXAMPLE 3

Into a reactor, 200 parts by weight of cumene were charged, and the temperature was raised to the reflux temperature. The following mixture was added dropwise under cumene reflux over 4 hours.

| Monomer mixture | Formulated ratio |
|---|---|
| Styrene monomer | 100 wt. parts |
| Di-tert-butylperoxide | 8 wt. parts |

Further, polymerization was completed under cumene reflux (146°-156 ° C.) and cumene was removed. The polystyrene obtained was soluble in THF had Mw =3,600, Mw/Mn =2.54, a main peak at a molecular weight of 3,600 and Tg =57 ° C. Th GPC chart of the polystyrene is shown in FIG. 2.

The above polystyrene (30 parts by weight) was dissolved in the following monomer mixture to provide a mixture.

| Monomer mixture | Formulated ratio |
|---|---|
| Styrene monomer | 53 wt. parts |
| n-Butyl acrylate monomer | 17 wt. parts |

-continued

| Monomer mixture | Formulated ratio |
|---|---|
| Divinylbenzene | 0.3 wt. parts |
| Benzoyl peroxide | 1 wt. part |
| tert-Butylperoxy-2-ethyl-hexanoate | 0.7 wt. part |

Into the above mixture, 170 parts by weight of water containing 0.2 part by weight of a partially saponified polyvinyl alcohol dissolved therein were added to form a suspension.

The above suspension was added into a reactor charged with 15 parts by weight of water and replaced with nitrogen, and suspension polymerization was carried out by using a stirring vane having a shape capable of providing high shear force at a stirring speed of 250 rpm at a temperature of 70 to 95 ° C. for 6 hours. After completion of the reaction, the product was filtered, dehydrated and dried to give a composition of a polystyrene and a styrene-n-butyl acrylate copolymer.

This composition contained THF-insoluble and THF-soluble homogeneously mixed therein, and the polystyrene and the styrene-n-butyl acrylate copolymer were found to be homogeneously mixed. The content of the THF-insoluble (measured as the powder of 24 mesh pass, 60 mesh on) was 37 wt. %. The molecular weight distribution of the THF-soluble was measured to give a result that there were peaks at the positions of about $0.39\times10^4$ and about $3.9\times10^4$ in the GPC chart, with Mn $=0.54\times10^4$, Mw$=14\times10^4$, Mw/Mn$=2.59$, and the molecular weight of $10^4$ or lower being 23 wt. %. Further, Tg of the resin was 58 ° C., and the glass transition point $Tg_1$ of the components of $10^4$ or less separated by GPC was 56 ° C. The thus obtained composition comprised spherical particles had a particle size of 0.17 mm in terms of 50 %-diameter in the cumulative distribution curve (D 50 %), and contained 2.5 wt. % of resin particles of 20 mesh-on.

The GPC chromatograph of the THF-soluble is shown in FIG. 1.

COMPARATIVE SYNTHESIS EXAMPLE 2

A resin composition was prepared in the same manner as in Synthesis Example 3 except that in the suspension polymerization, 0.05 wt. parts of partially saponified polyvinyl alcohol was used and stirring was regulated so as to provide a rotation speed of a stirring vane of 100 rpm. The thus obtained resin composition had substantially the same characteristics as those in Synthesis Example 3, but the D 50 % was 0.75 mm and the composition contained 7 wt. % of resin particles of 20 mesh-on.

SYNTHESIS EXAMPLE 4

Into a reactor, 150 parts by weight of cumene was charged, and the temperature was raised to the reflux temperature. The following mixture was added dropwise under cumene reflux over 4 hours.

| Monomer Mixture | Formulated ratio |
|---|---|
| Styrene monomer | 100 wt. parts |
| Di-tert-butyl peroxide | 4 wt. parts |

Further, polymerization was completed under cumene reflux (146°-156 ° C.) and cumene was removed. The styrene polymer obtained had Mw $=6,900$, Mw/Mn $=2.3$, a main peak at a molecular weight of 7,100, and Tg $=68$ ° C.

The above styrene polymer (40 parts by weight) was dissolved in the following monomer mixture to provide a mixture.

| Monomer mixture | Formulated ratio |
|---|---|
| Styrene monomer | 37 wt. parts |
| n-Butyl methacrylate monomer | 23 wt. parts |
| Divinylbenzene | 0.24 wt. parts |
| Benzoyl peroxide | 0.65 wt. parts |
| tert-Butylperoxy-2-ethyl-hexanoate | 0.85 wt. parts |

Into the above mixed solution, 170 parts by weight of water containing 0.2 part by weight of a partially saponified polyvinyl alcohol dissolved therein were added to form a suspension.

The above suspension was added into a reactor charged with 15 parts by weight of water and replaced with nitrogen, and the reaction was carried out by using the same vane as in Synthesis Example 3 at a rotating speed of 250 rp at a temperature of 70 to 95 ° C. for 6 hours.

The thus obtained resin composition comprised substantially spherical particles, had a D 50 % of 0.4 mm, and contained 4 wt. % of resin particles of 20 mesh-on.

The content of the THF-insoluble was 30 wt. %. The molecular weight distribution of the THF-soluble was measured to give a result that there were peaks at the positions of about $0.71\times10^4$ and about $4.1\times10^4$ in the GPC chart, with Mw/Mn $=28$, and the molecular weights of $10^4$ or lower being 40 wt.%. Further, Tg of the resin was 58 ° C., and the glass transition point $Tg_1$ of the components of $10^4$ or less separated by GPC was 66 ° C.

SYNTHESIS EXAMPLE 5

Into a reactor, 200 parts by weight of cumene were charged, and the temperature was raised to the reflux temperature. The following mixture was added dropwise under cumene reflux over 4 hours.

| Monomer mixture | Formulated ratio |
|---|---|
| Styrene monomer | 100 wt. parts |
| di-tert-butylperoxide | 7 wt. parts |

Further, polymerization was completed under cumene reflux (146°-156 ° C.) and cumene was removed. The polystyrene obtained had Mw $=4,000$, Mw/Mn $=2.80$, a main peak at a molecular weight of 4,000, and Tg $=60$ ° C.

The above polystyrene (30 parts by weight) was dissolved in the following monomer mixture to provide a mixture.

| Monomer mixture | Formulated ratio |
|---|---|
| Styrene monomer | 54 wt. parts |
| N-butyl acrylate monomer | 16 wt. parts |
| Divinylbenzene | 0.3 wt. parts |
| Benzoyl peroxide | 1.4 wt. parts |

Into the above mixture, 170 parts by weight of water containing 0.2 part by weight of a partially saponified polyvinyl alcohol having a polymerization degree of 2000 dissolved therein were added to form a suspension.

The above suspension was added into a reactor charged with 15 parts by weight of water and replaced with nitrogen, and the reaction was carried out by using a stirring vane having a shape capable of providing high shear force at a stirring speed of 250 rpm at a temperature of 70 to 95 ° C. for 6 hours. After completion of the reaction, the product was filtered, dehydrated and dried to give a composition of a polystyrene and styrene-n-butyl acrylate copolymer.

This composition contained THF-insoluble and THF-soluble homogeneously mixed therein, and the polystyrene and the styrene-n-butyl acrylate copolymer were found to be homogeneously mixed. The thus obtained composition comprised spherical particles and aggregates thereof, had a particle size of 0.10 mm in terms of 50 %-diameter in the cumulative distribution curve, and contained 2 wt. % of resin particles of 20 mesh-on. The molecular weight distribution of the THF-soluble was measured to give a result that there were peaks at the positions of about $0.42\times10^4$ and about $3.5\times10^4$ in the GPC chart, with $Mn=0.56\times10^4$, $Mw=14\times10^4$, $Mw/Mn=2.5$ and the molecular weights of $10^4$ or lower being 25 wt. %. Further, Tg of the resin was 60 ° C., and the glass transition point $Tg_1$ of the components of $10^4$ or less separated by GPC was 60 ° C.

Figure 6:
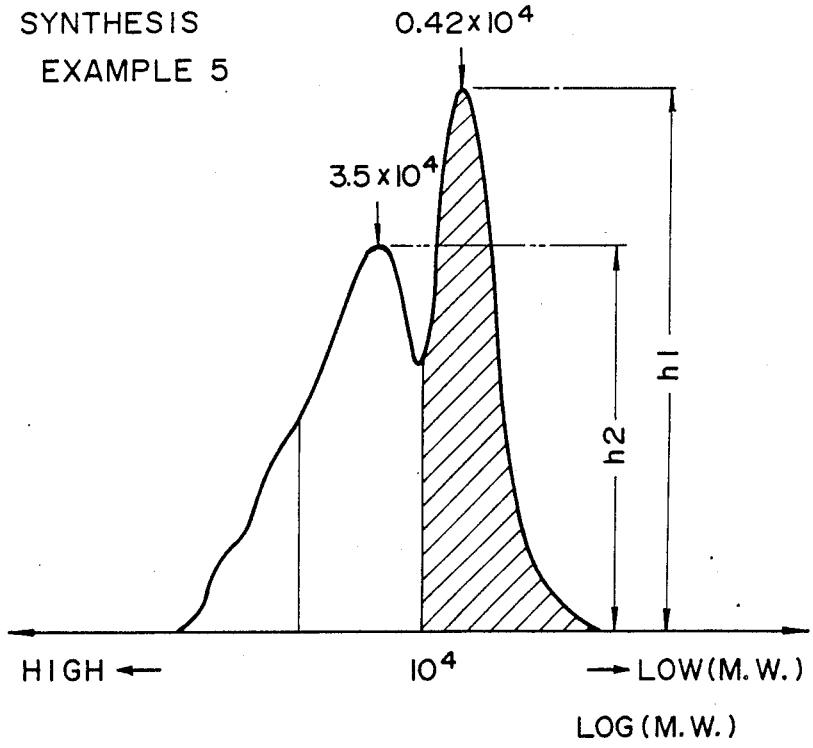
FIG. 6 shows a GPC chromatogram of the THF-soluble of the resin composition prepared in Synthesis Example 5.

The GPC chromatogram of the THF-soluble is shown in FIG. 6.

SYNTHESIS EXAMPLE 6

Into a reactor, 200 parts by weight of cumene were charged, and the temperature was raised to the reflux temperature. The following mixture was added dropwise under cumene reflux over 4 hours.

| Monomer mixture | Formulated ratio |
|---|---|
| Styrene monomer | 100 wt. parts |
| α-Methylstyrene monomer | 3 wt. parts |
| Di-tert-butylperoxide | 8 wt. parts |

Further, polymerization was completed under cumene reflux (146°-156 ° C.) and cumene was removed. The styrene-α-methylstyrene copolymer obtained had Mw =4,500, Mw/Mn =2.7, a main peak at a molecular weight of 4,400, and Tg =61 ° C.

The above styrene-α-methylstyrene copolymer (30 parts by weight) was dissolved in the following monomer mixture to provide a mixture.

| Monomer mixture | Formulated ratio |
|---|---|
| Styrene monomer | 55 wt. parts |
| 2-Ethylhexyl acrylate monomer | 15 wt. parts |
| Divinylbenzene | 0.3 wt. parts |
| Benzoyl peroxide | 1.3 wt. parts |

Into the above mixture, 170 parts by weight of water containing 0.15 part by weight of a partially saponified polyvinyl alcohol having a polymerization degree of 2000 dissolved therein were added to form a suspension.

The above suspension was added into a reactor charged with 15 parts by weight of water and replaced with nitrogen, and the reaction was carried out in the same manner as in Synthesis Example 5 at a temperature of 70 to 95 ° C. for 6 hours. After completion of the reaction, the product was filtered, dehydrated and dried to give a composition of a styrene-α-methylstyrene copolymer and styrene-2-ethylhexyl acrylate copolymer.

The thus obtained composition comprised spherical particles and aggregates thereof, had a particle size of 0.7 mm in terms of 50 %-diameter in the cumulative distribution curve, and contained 5 wt. of resin particles of 20 mesh-on.

The molecular weight distribution of the THF-soluble was measured to give a result that there were peaks at the positions of about $0.5\times10^4$ and about $4.4\times10^4$ in the GPC chart, with $Mn=0.64\times10^4$, $Mw=14\times10^4$, $Mw/Mn=22$ and the molecular weights of $10^4$ or lower being 20 wt. %. Further, Tg of the resin was 57 ° C., and the glass transition point $Tg_1$ of the components of $10^4$ or less separated by GPC was 61° C.

SYNTHESIS EXAMPLE 7

Into a reactor, 100 parts by weight of toluene were charged, and the temperature was raised to the reflux temperature. The following mixture was added dropwise under cumene reflux over 4 hours.

| Monomer mixture | Formulated ratio |
|---|---|
| Styrene monomer | 100 wt. parts |
| Di-tert-butylperoxide | 6 wt. parts |

Further, polymerization was completed under toluene reflux and toluene was distilled off under reduced pressure. The polystyrene obtained was soluble in THF and had Mw =4,800, Mw/Mn =3.21, a main peak at a molecular weight of 5,100, and Tg =62 ° C.

The above polystyrene (30 parts by weight) was dissolved in the same monomer mixture as in Synthesis Example 5 to provide a mixture.

Into the above mixture, 250 parts by weight of water containing 0.1 part by weight of a partially saponified polyvinyl alcohol having a polymerization degree of 2000 dissolved therein were added to form a suspension.

The above suspension was subjected to suspension polymerization in the same manner as in Synthesis Example 5 at a stirring speed of 200 rpm, to obtain a resin composition.

The thus obtained resin composition comprised spherical particles and aggregates thereof, had a particle size of 0.13 mm in terms of 50 %-diameter in the cumulative distribution curve (D 50 %), and contained 3.2 wt. % of resin particles of 20 mesh sieve-on.

The content of THF-insoluble was 30 wt. The molecular weight distribution of the THF-soluble was measured to give a result that there were peaks at the positions of about $0.51\times10^4$ and about $3.8\times10^4$ in the GPC chart, with $Mn=0.53\times10^4$, $Mw=15\times10^4$, $Mw/Mn=28.3$ and the molecular weights of 104 or lower being 26 wt. %. Further, Tg of the resin was 61 ° C., and the glass transition point $Tg_1$ of the components of $10^4$ or less separated by GPC was 60 ° C.

SYNTHESIS EXAMPLE 8

A resin composition was obtained in the same manner as in Synthesis Example 5 except that 0.2 part of triethylene glycol dimethacrylate was added instead of divinylbenzene, 0.1 part of partially saponified polyvinyl alcohol having a polymerization degree of 2000 was used, 200 parts of water was used as dispersion medium, and the rotating speed was 230 rpm.

The thus obtained resin composition comprised spherical particles and aggregates thereof, had a particle size of 0.5 mm in terms of 50 %-diameter in the cumulative distribution curve (D 50 %), and contained 4 wt. of resin particles of 20 mesh sieve-on.

The content of THF-insoluble was 35 wt. The molecular weight distribution of the THF-soluble was measured to give a result that there were peaks at the positions of about $0.4\times10^4$ and about $4.0\times10^4$ in the GPC chart, with $Mn=0.60\times10^4$, $Mw=19\times10^4$, $Mw/Mn=31.7$ and the molecular weights of $10^4$ or lower being 23 wt. %. Further, Tg of the resin was 59 ° C., and the glass transition point Tg1 of the components of $10^4$ or less separated by GPC was 59 ° C.

EXAMPLE 1

| | |
|---|---|
| Resin composition of Synthesis Example 1 | 100 wt. parts |
| Spherical magnetic material*1 (magnetite, bulk density: 0.9 g/ml, average particle size: 0.25 micron) | 60 wt. parts |
| Monoazo-type negative charge controlling agent (CA-2; M = Co) | 0.5 wt. part |
| Low-molecular weight polypropylene | 3 wt. parts |

*1The content of particles having a ratio of (longer axis/shorter axis) of 1.2 or below was 80% by number or more.)

The above materials were premixed and then kneaded on a two-roll mill heated to 150 ° C. for 20 min. After the kneaded product was left to cool, it was coarsely crushed by a cutter mill, then pulverized with the use of a micropulverizer by use of jet air stream, further classified by a wind-force classifier to obtain a negatively chargeable insulating magnetic toner (black fine powder) with a volume-average size of 12.0 microns. With 100 wt. parts of the thus obtained black fine powder, 0.6 wt. part of hydrophobic colloidal silica fine powder was mixed by dry mixing to obtain a toner (or developer) containing externally added silica.

The thus obtained toner was then subjected to an image formation test by means of a laser-beam printer (LBP-8, mfd. by Canon K.K.) equipped with an OPC photosensitive member and a heat roller fixing device, wherein a 300 dpi (dot pin inch)-laser beam was used for forming a negative latent image and reversal development was conducted. During the test, the temperature of the heat roller was set to 170 ° C. The original image used herein was "one dot-two space" image of A-4 size wherein the ratio of the are of the latent image zone to that of the blank zone was 1:2 (i.e., a thin-line image wherein each thin line portion had a width of about 100 microns, and the intervals had a width of 200 microns).

As a result of such image formation test, good images free of toner scattering or reversal fog were successively obtained until the toner was completely consumed and no problem of filming occurred.

The above-mentioned image formation test was repeated by using the same printer from which the cleaning mechanism had been removed. As a result, there occurred no problem in fixability or offset.

EXAMPLE 2

| | |
|---|---|
| Resin composition of Synthesis Example 2 | 100 wt. parts |

-continued

| | |
|---|---|
| Spherical magnetic material*2 (magnetite, bulk density: 0.6 g/ml, average particle size: 0.2 micron) | 60 wt. parts |
| Monoazo-type negative charge controlling agent (CA-2; M = Co) | 2 wt. part |
| Low-molecular weight polypropylene | 3 wt. parts |

*2The content of particles having a ratio of (longer axis/shorter axis) of 1.2 or below was 80% by number or more.)

The above materials were premixed and then subjected to the same procedure to obtain a toner.

The thus obtained toner wa then subjected to an image formation test in the same manner as in Example 1 except that a 400 dpi-laser beam was used and the temperature of the heat roller was set to 160 ° C.

As a result of such image formation test, good images free of toner scattering or reversal fog were successively obtained until the toner was completely consumed and no problem of fixability or offset occurred.

COMPARATIVE EXAMPLE 1

| | |
|---|---|
| Resin composition of Synthesis Example 1 | 100 wt. parts |
| Cubic system magnetic material*3 (bulk density: 0.55 g/ml, average particle size: 0.25 micron) | 60 wt. parts |
| Negative charge controlling agent (zinc salt of benzoic acid) | 1 wt. part |
| Low-molecular weight polypropylene | 3 wt. parts |

*3The ratio of (longer axis/shorter axis) was 1.3 or above.)

The above materials were premixed and then subjected to the same procedure to obtain a toner.

The thus obtained toner was then subjected to an image formation test in the same manner as in Example 1.

As a result of such image formation test, toner scattering somewhat occurred, and the image obtained at the time of 500 sheets of copying was not practically usable and clearly inferior to that obtained in Example 1.

Along with successive copying, image density had a tendency to decrease. When the dispersibility was evaluated by observing the gloss of the kneaded product, it was inferior to that obtained in Example 1 and not good.

COMPARATIVE EXAMPLE 2

| | |
|---|---|
| Resin composition of Comparative Example 1 | 100 wt. parts |
| Spherical magnetic material (bulk density: 0.9 g/ml, average particle size: 0.3 micron) | 60 wt. parts |
| Negative charge controlling agent | 1 wt. parts |
| Low-molecular weight polypropylene | 3 wt. parts |

The above materials were premixed and then subjected to the same procedure as in Example 1 to obtain a toner.

The thus obtained toner was then subjected to an image formation test in the same manner as in Example 2.

As a result of such image formation test, good images free of toner scattering were successively obtained until the toner was completely consumed and no problem of filming occurred, but the image density was somewhat low and not good. Further, the fixability was considerably poor and was such that it caused a serious problem in practice.

EXAMPLE 3

| | |
|---|---|
| Resin composition of Synthesis Example 1 | 100 wt. parts |
| Spherical magnetic material*4 (magnetite, bulk density: 0.9 g/ml, average particle size: 0.3 micron) | 60 wt. parts |
| Monoazo-type negative charge controlling agent (CA-2; M = Cr) | 1.0 wt. part |
| Low-molecular weight polypropylene | 2 wt. parts |

*4The content of particles having a ratio of (longer axis/shorter axis) of 1.2 or below was 80% by number or more.)

The above materials were premixed and then kneaded by means of an extruder set to 150 ° C. the surface of the kneaded product had a gloss and therefore it was considered that the magnetic material was well dispersed in the kneaded product.

The kneaded product was coarsely crushed, then pulverized and classified by a wind-force classifier to obtain toner powder with a volume-average particle size of 9.5 microns. With the thus obtained toner powder, colloidal silica was mixed in the same manner as in Example 1 to obtain a toner (or developer) containing externally added silica.

The developer was subjected to an image formation test by means of a high-speed copying machine NP-8570 (mfd. by Canon K.K., 70 sheets/min., 100 V). As a result of successive image formation (durability) test of about 100,000 sheets, the image density was 1.45 from the initial stage and was stable. The resultant images were excellent in reproducibility in thin lines and halftone.

With respect to fixing, even when the above test as repeated by removing the cleaning device from the copying machine, offset phenomenon was not observed, and anti-winding characteristic was also good. Further, when the set temperature of the fixing roller was decreased by 10 ° C., the toner image was sufficiently fixed.

Further, no sticking was observed on the photosensitive member and no sticking occurred in the pulverizer used for producing the toner.

EXAMPLE 4

A toner was prepared in the same manner as in Example 1 except that there were used spherical magnetic particles which had a bulk density of 1.0 g/ml and comprised 80 % by number or more of particles having a ratio of (longer axis/shorter axis) of 1.2 or below.

The resultant toner had a volume-average particle size of 11.5 microns which was substantially the same as that obtained in Example 1. The toner was then mixed with colloidal silica in the same manner as in Example 1 to obtain a toner containing externally added silica, which was evaluated in the same manner as in Example 1.

As a result, performances in fixing was substantially the same as in Example 1, but the results of the image formation were better than those in Example 1.

In order to evaluate reversal fog, the abovementioned test was repeated by modifying the copying machine so that the potential in the non-image portion became severer (i.e., the potential was regulated so as to easily cause reversal fog). As a result, it was found that the room for the prevention of reversal fog was 60 V larger than that in Example 1.

EXAMPLE 5

A toner was prepared in the same manner as in Example 1 except that there were used spherical magnetic particles which had a bulk density of 0.6 g/ml and comprised 80 % by number or more of particles having a ratio of (longer axis/shorter axis) of 1.2 or below.

When the resultant toner was subjected to an image formation test in the same manner as in Example 1, there were obtained good images free of scattering or fog, but the comprehensive of the toner of instance was somewhat inferior to that of Example 1.

EXAMPLE 6

A toner was prepared in the same manner as in Example 1 except that dialkylsalicylic acid chromium complex was used instead of the monoazo-type negative charge controller.

When the resultant toner was subjected to a digital-type image formation test in the same manner as in Example 1, slight decrease in image quality was observed as compared with that in Example 1.

EXAMPLE 7

| | |
|---|---|
| Resin composition of Synthesis Example 4 | 100 wt. parts |
| Spherical magnetic material*5 (magnetite, bulk density: 1.0 g/ml, | 60 wt. parts |
| Negative charge controlling agent | 0.5 wt. part |
| Low-molecular weight polypropylene | 2 wt. parts |

*5The content of particles having a ratio of (longer axis/shorter axis) of 1.2 or below was 80% by number or more.)

The above materials were premixed (herein, the mixability of powders was uniform) and then kneaded on a two-roll mill heated to 150 ° C. for 20 min. After the kneaded product was left to cool, it was coarsely crushed by a cutter mill, then pulverized with the use of a micropulverizer by use of jet air stream, further classified by a wind-force classifier to obtain black fine powder (toner) with a volume-average size of 11.0 microns.

In the above kneading step, the mixability of the powders was good and the kneaded product had a smooth surface showing good dispersibility.

With 100 wt. parts of the thus obtained black fine powder, 0.4 wt. part of colloidal silica fine powder was mixed by dry mixing to obtain a toner (or developer) containing externally added silica.

The toner was evaluated by means of a copying machine NP-8570 (mfd. by Canon K.K.) which had been modified so as to provide a copying speed of 85 sheets/min. instead of 70 sheets/min. The results are shown in Table appearing hereinafter.

EXAMPLE 8

| | |
|---|---|
| Resin composition of Synthesis Example 4 | 100 wt. parts |
| Spherical magnetic material*6 (magnetite, bulk density: 0.8 g/ml) | 60 wt. parts |
| Positive charge controlling agent (Nigrosine) | 2 wt. part |
| Low-molecular weight polypropylene | 2 wt. parts |

*6The content of particles having a ratio of (longer axis/shorter axis) of 1.2 or below was 80% by number or more.)

By using the above materials, a toner was prepared in the same manner as in Example 7.

In the kneading step, the mixability of the powders was good and the kneaded product had a smooth surface showing good dispersibility.

With 100 wt. parts of the thus obtained toner (black fine powder), 0.4 wt. part of colloidal silica fine powder was mixed by dry mixing to obtain a toner (or developer) containing externally added silica.

The toner was evaluated by means of a copying machine NP-5540 (mfd. by Canon K.K.) which had been modified so as to provide a copying sheet of 60 sheets/-min. instead of 40 sheets/min. The results are shown in Table appearing hereinafter.

| | Pulverizability in toner production | Anti-sticking property | Fixability *1 | Image quality (initial image) density) | Number of sheets in successive copying *2 |
|---|---|---|---|---|---|
| Example 7 | Good (17 kg/hr) | Good | Good (10%) | Good (1.50) | 150,000 sheets |
| Example 8 | Good (17.2 kg/hr) | Good | Good (7%) | Good (1.48) | 120,000 sheets |

*1: Fixability was measured by rubbing the image with lens cleaning paper (Shirulon-C paper) reciprocally for 10 times under a load of about 100 g, and peeling of the image was represented by a lowering in percentage (%) of the reflective density. The evaluation of image was effected on a 200th sheet when 200 copies were continuously taken.

*2: The number of sheets which provided good images in successive copying.

What is claimed is:

1. A magnetic toner for developing electrostatic images, comprising at least a binder resin and a magnetic powder; said binder resin having 10 to 70 wt. of a THF (tetrahydrofuran)-insoluble and a THF-soluble, the THF-soluble providing a molecular weight distribution in the chromatogram of GPC (gel permeation chromatography) thereof such that it provides a rate (Mw/Mn) of weight-average molecular weight (Mw)/number-average molecular weight (Mn)≧5, there are a peak in the molecular weight range of 2,000 to 10,000 and a peak or shoulder in the molecular weight range of 15,000 to 100,000, and a component having a molecular weight of 10,000 or smaller is contained in an amount of 10–50wt. % based on the binder resin; said magnetic powder comprising spherical magnetic particles having a bulk density of 0.6 g/ml or larger.

2. A magnetic toner according to claim 1, wherein the spherical magnetic particles have a bulk density of 0.7 g/ml or larger.

3. A magnetic toner according to claim 1, wherein the spherical magnetic particles have a bulk density of 0.9 g/ml to 155 g/ml.

4. A magnetic toner according to claim 1, wherein the spherical magnetic particles are contained in an amount of 40–200 wt. parts per 100 wt. parts of binder resin.

5. A magnetic toner according to claim 1, wherein the spherical magnetic particles are contained in an amount of 50–150 wt. parts per 100 wt. parts of binder resin.

6. A magnetic toner according to claim 1, wherein the spherical magnetic particles have an average particle size of 0.1–1 micron.

7. A magnetic toner according to claim 1, wherein the spherical magnetic particles have an average particle size of 0.1–0.5 micron.

8. A magnetic toner according to claim 1, wherein the spherical magnetic particles comprise 70 % by number or more of magnetic particles having a ratio of longer axis to shorter axis of 1.2 or smaller.

9. A magnetic toner according to claim 1, wherein the spherical magnetic particles comprise 80 % by member or more of magnetic particles having a ratio of longer axis to shorter axis of 1.2 or smaller.

10. A magnetic toner according to claim 1, wherein the THF-soluble of the binder resin contains 20–39 wt. % of a component having a molecular weight of 10,000 or smaller based on the weight of the THF-soluble.

11. A magnetic toner according to claim 1, wherein the THF-soluble of the binder resin provides a molecular weight distribution in the GPC chromatogram thereof such that there are a peak in the molecular weight range of 2,000 to 8,000 and a peak or shoulder in the molecular weight range of 20,000 to 70,000.

12. A magnetic toner according to claim 1, wherein the THF-soluble of the binder resin has a ratio (Mw/Mn) of 5–80.

13. A magnetic toner according to claim 1, wherein the THF-soluble of the binder resin has a ratio (Mw/Mn) of 10–60.

14. A magnetic toner according to claim 1, wherein the binder resin contains 15 - 49 wt. % of the THF-insoluble.

15. A magnetic toner according to claim 11, wherein the THF-soluble of the binder resin provides a ratio $h_1/h_2$ in the range of 0.4/1 to 4.0/1 in the GPC chromatogram thereof, wherein $h_1$ denotes the height of the highest peak in the molecular weight range of 2,000 to 10,000, and $h_2$ denotes the height of the highest peak in the molecular weight range of 15,000 to 100,000.

16. A magnetic toner according to claim 1, wherein the binder resin comprises a vinyl-type polymer.

17. A magnetic toner according to claim 16, wherein the binder resin comprises a styrene-type polymer, styrene-type copolymer, or a mixture thereof.

18. A magnetic toner according to claim 17, wherein the binder resin comprises a crosslinked styrene-type copolymer.

19. A magnetic toner according to claim 17, wherein the binder resin comprises a crosslinked styrene-type polymer and a crosslinked styrene-type copolymer.

20. A magnetic toner according to claim 17, wherein the styrene-type copolymer is a styreneacrylic acid ester copolymer or a styrene-methacrylic acid ester copolymer.

21. A magnetic toner according to claim 1, wherein the binder resin has a glass transition point of 40°–80° C.

22. A magnetic toner according to claim 1, which further comprises a monoazo-type metal complex.

23. A magnetic toner according to claim 22, wherein the monoazo-type metal complex is contained in an amount of 0.1–5 wt. parts per 100 wt. parts of the binder resin.

24. A magnetic toner obtained by mixing a binder resin and magnetic powder having a bulk density of 0.6 g/ml or larger in their powder states, thermally kneading the resultant mixture and pulverizing the kneaded product; said binder resin comprising substantially spherical particles having an average particle size of 0.1–0.7 mm or aggregates thereof; said binder resin having 10 to 70 wt. % of a THF (tetrahydrofuran)-insoluble and a THF-soluble, the THF-soluble providing a molecular weight distribution in the chromatogram of GPC (gel permeation chromatography) thereof such that it provides a rate (Mw/Mn) of weight-average molecular weight (Mw)/number-average molecular weight (Mn)≧5, there are at least one peak in the molecular weight range of 2,000 to 10,000 and at least one peak or shoulder in the molecular weight range of 15,000 to 100,000, and a component having a molecular weight of 10,000 or smaller is contained in an amount of 10–50 Wt. % based on the weight of the binder resin.

* * * * *

UNITED STATES PATENT AND TRADEMARK OFFICE

CERTIFICATE OF CORRECTION

PATENT NO. : 4,939,060 Page 1 of 5

DATED : July 3, 1990

INVENTOR(S) : Koichi Tomiyama et al.

It is certified that error appears in the above-identified patent and that said Letters Patent is hereby corrected as shown below:

COLUMN 1:

Line 32, "ar" should read --are--.

Line 65, "sine" should read --since--.

COLUMN 2:

Line 42, "an" should read --and--.

COLUMN 3:

Line 18, "to this resin" should read --this resin to--.

Line 38, "thinline" should read --thin-line--.

Line 61, "system" should read --system,--.

COLUMN 5:

Line 67, "an" should read --and--.

COLUMN 6:

Line 54, "I" should read --In--.

UNITED STATES PATENT AND TRADEMARK OFFICE

CERTIFICATE OF CORRECTION

PATENT NO. : 4,939,060

DATED : July 3, 1990

INVENTOR(S) : Koichi Tomiyama et al.

It is certified that error appears in the above-identified patent and that said Letters Patent is hereby corrected as shown below:

COLUMN 7:

Line 65, "8produced" should read --produced--.

COLUMN 9:

Line 17, "weighth" should read --weight--.

Line 22, "to" should read --to as--.

Line 27, "included" should read --be included--.

COLUMN 10:

Line 40, "points" should read --point--.

Line 64 "ricker" should read --richer--.

COLUMN 11:

Line 27, "broken)." should read --broken line).--.

Line 58, "is" should read --are--.

UNITED STATES PATENT AND TRADEMARK OFFICE

CERTIFICATE OF CORRECTION

PATENT NO. :4,939,060 Page 3 of 5

DATED :July 3, 1990

INVENTOR(S) :Koichi Tomiyama et al.

It is certified that error appears in the above-identified patent and that said Letters Patent is hereby corrected as shown below:

COLUMN 12:

Line 27, "depends" should read --depend--.

Line 63, "0.7 ml/g" should read --0.7 g/ml--.

COLUMN 14:

Line 44, "particle" should read --particles--.

COLUMN 18:

Line 56, "THF" should read --THF,--.

COLUMN 19:

Line 36, "particles" should read --particles,--.

COLUMN 20:

Line 24, "250 rp" should read --250 rpm--.

COLUMN 22:

Line 58, "104" should read --$10^4$--.

UNITED STATES PATENT AND TRADEMARK OFFICE

CERTIFICATE OF CORRECTION

PATENT NO. : 4,939,060 Page 4 of 5

DATED : July 3, 1990

INVENTOR(S) : Koichi Tomiyama et al.

It is certified that error appears in the above-identified patent and that said Letters Patent is hereby corrected as shown below:

COLUMN 23:

Line 15, "glass transition point Tgl" should read --glass transition point $Tg_1$--.

Line 52, "are" should read --area--.

COLUMN 24:

Line 13, "wa" should read --was--.

COLUMN 27:

Line 31, "70 wt." should read --70 wt. %--.

Line 50, "155 g/ml." should read --1.5 g/ml.--.

UNITED STATES PATENT AND TRADEMARK OFFICE

CERTIFICATE OF CORRECTION

PATENT NO. : 4,939,060

DATED : July 3, 1990

INVENTOR(S) : Koichi Tomiyama, et al.

It is certified that error appears in the above-identified patent and that said Letters Patent is hereby corrected as shown below:

COLUMN 28:

Line 56, "styreneacrylic acid" should read --styrene-acrylic acid--.

Signed and Sealed this

Twenty-third Day of June, 1992

*Attest:*

DOUGLAS B. COMER

*Attesting Officer*

*Acting Commissioner of Patents and Trademarks*